US011069229B2

(12) United States Patent
Fowe et al.

(10) Patent No.: US 11,069,229 B2
(45) Date of Patent: Jul. 20, 2021

(54) PROBE BASED VARIABLE SPEED SIGN VALUE

(71) Applicant: HERE Global B.V., Eindhoven (NL)

(72) Inventors: James Adeyemi Fowe, Evanston, IL (US); Catalin Capota, Palatine, IL (US); Leon Oliver Stenneth, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 338 days.

(21) Appl. No.: 16/140,812

(22) Filed: Sep. 25, 2018

(65) Prior Publication Data

US 2019/0035265 A1 Jan. 31, 2019

Related U.S. Application Data

(63) Continuation of application No. 14/509,487, filed on Oct. 8, 2014, now Pat. No. 10,109,184.

(51) Int. Cl.

| | |
|---|---|
| ***G08G 1/01*** | (2006.01) |
| ***G08G 1/0967*** | (2006.01) |
| ***G08G 1/052*** | (2006.01) |

(52) U.S. Cl.

CPC ..... *G08G 1/0112* (2013.01); *G08G 1/0116* (2013.01); *G08G 1/0129* (2013.01); (Continued)

(58) Field of Classification Search

CPC .. G08G 1/0112; G08G 1/0116; G08G 1/0129; G08G 1/0141; G08G 1/052; (Continued)

(56) References Cited

U.S. PATENT DOCUMENTS

| | | | |
|---|---|---|---|
| 6,204,778 | B1 | 3/2001 | Bergan et al. |
| 7,433,889 | B1 | 10/2008 | Barton |

(Continued)

FOREIGN PATENT DOCUMENTS

| | | | |
|---|---|---|---|
| DE | 3128578 | A1 | 2/1983 |
| DE | 102012216788 | A1 | 5/2014 |

(Continued)

OTHER PUBLICATIONS

Patel, Abhishekand Singh, Purnima, New Approach for K-mean and K-medoid Algorithms, 2013, International Journal of Computer Applications Technology and Research, vol. 2-Issue 1, 1-5, 2013 (Year: 2013).*

(Continued)

*Primary Examiner* — Hunter B Lonsberry
*Assistant Examiner* — Matthew J. Reda
(74) *Attorney, Agent, or Firm* — Lempia Summerfield Katz, LLC

(57) ABSTRACT

Systems, methods, and apparatuses are disclosed for predicting or estimating the value of a variable speed sign (VSS). A variable speed sign is identified. Probe data is collected at one or more vehicles in proximity to the variable speed sign. The speeds of the vehicles are included in or derived from the probe data. A statistical analysis is performed on the probe data. A speed limit value for the variable speed sign is determined based on the statistical analysis.

20 Claims, 9 Drawing Sheets

(52) U.S. Cl.
CPC ..... *G08G 1/0141* (2013.01); *G08G 1/052* (2013.01); *G08G 1/0967* (2013.01); *G08G 1/096716* (2013.01); *G08G 1/096741* (2013.01); *G08G 1/096775* (2013.01)

(58) Field of Classification Search
CPC ..... G08G 1/0967; G08G 1/096716; G08G 1/096741; G08G 1/096775
See application file for complete search history.

(56) References Cited

U.S. PATENT DOCUMENTS

| | | | | |
|---|---|---|---|---|
| 8,255,144 | B2 | 8/2012 | Breed et al. | |
| 8,494,759 | B2 * | 7/2013 | Hada | G08G 1/0145 701/117 |
| 2006/0034484 | A1 | 2/2006 | Bahlmann et al. | |
| 2007/0216521 | A1 * | 9/2007 | Guensler | G08G 1/09675 340/439 |
| 2009/0140887 | A1 | 6/2009 | Breed et al. | |
| 2010/0299055 | A1 * | 11/2010 | Hilbrandie | G08G 1/096888 701/532 |
| 2011/0153189 | A1 * | 6/2011 | Chiang | G01C 21/3492 701/533 |
| 2011/0248867 | A1 | 10/2011 | Lee et al. | |
| 2011/0301802 | A1 | 12/2011 | Rupp et al. | |
| 2012/0173530 | A1 | 7/2012 | Kurciska et al. | |
| 2012/0283942 | A1 | 11/2012 | T'Siobbel et al. | |
| 2013/0297211 | A1 | 11/2013 | Burr et al. | |
| 2020/0050209 | A1 * | 2/2020 | Bai | B60K 31/0058 |

FOREIGN PATENT DOCUMENTS

| | | |
|---|---|---|
| EP | 2383679 A1 | 11/2011 |
| WO | 1996011458 | 4/1996 |
| WO | 1996036929 | 11/1996 |
| WO | 2009035697 | 3/2009 |
| WO | 2009100058 | 8/2009 |

OTHER PUBLICATIONS

Llorca et al., Vision-Based Traffic Data Collection for Floating Car Data Enhancement, 2010, University of Alcala.

PCT International Search Report and Written Opinion of the International Searching Authority dated Dec. 16, 2015 for corresponding PCT/IB2015/057567.

Private Probe Vehicle Data for Real Time Applications, Final Report, Sep. 23, 2011, azmag.gov/Documents/TS_2011-10-27_Private-Probe-Vehicle-Data-for-RealTime-Applications-Final-Report.pdf.

European Office Action for European Patent Application No. 15 781 438.5-1203 dated Mar. 4, 2021.

* cited by examiner

PROBE BASED VARIABLE SPEED SIGN VALUE

This application is a continuation under 35 U.S.C § 120 and 37 CRF § 1.53(b) of U.S. patent application Ser. No. 14/509,487 filed Oct. 8, 2014, the disclosure of which is incorporated herein by reference in its entirety.

FIELD

The following disclosure relates to variable speed signs, or more particularly, algorithms for determining variable speed sign values.

BACKGROUND

Variable speed signs (VSS) are used to report variable speed limits in certain areas. VSS allow operators to adjust (e.g., raise or lower) the posted speed limit without changing a physical sign. The signs may be used in conjunction with intelligent transportation systems to adjust speed limits for several reasons including congestion, construction, accidents, or weather conditions. As technology advances, the ease of use of VSS is also increasing. Reported speed limits may be changed on the VSS remotely via email or telephone, at specific times of day, or manually via a control panel. VSS also may be used to alter speed limits based on real time traffic, weather conditions, or construction.

Municipalities (e.g., traffic management centers) that control the VSS may be unwilling to communicate the real time speed limits displayed on the VSS to third parties. In addition, automatic techniques for reading speed values from a VSS remain unreliable. Accordingly, there is a continuing effort to provide improved systems and methods for determining speed values from a VSS.

SUMMARY

Systems, methods, and apparatuses are disclosed for predicting or estimating the value of a variable speed sign (VSS). A variable speed sign is identified. Probe data is collected at one or more vehicles in proximity to the variable speed sign. The speeds of the vehicles are included in or derived from the probe data. A statistical analysis is performed on the probe data. A speed limit value for the variable speed sign is determined based on the statistical analysis.

BRIEF DESCRIPTION OF THE DRAWINGS

Exemplary embodiments are described herein with reference to the following drawings.

DETAILED DESCRIPTION

Figure 1:
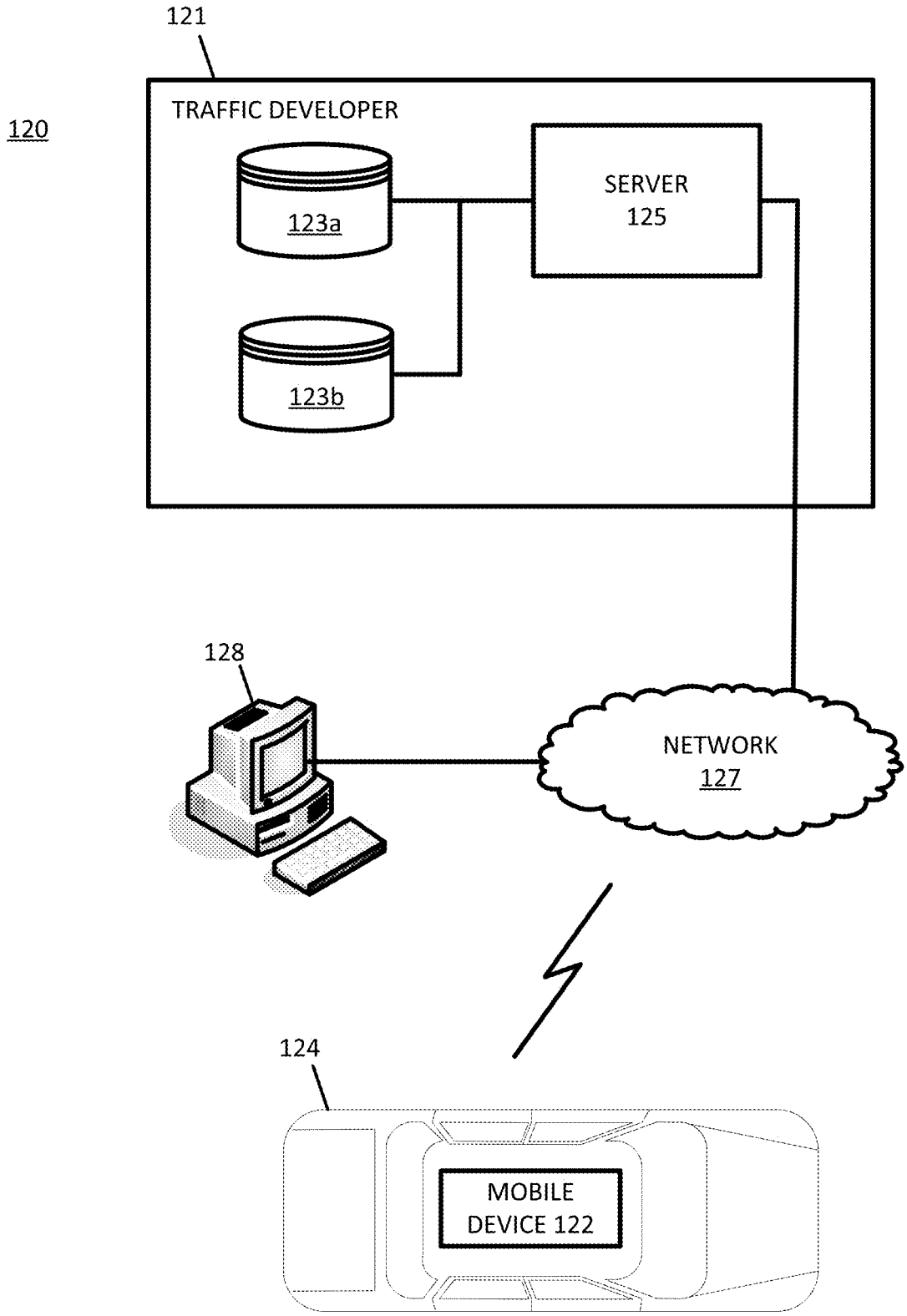
FIG. 1 illustrates an example system for determining speed values for a variable speed sign.

A variable speed sign may be used on a roadway to give travelers information about the road ahead. Speed limit values may be displayed on electronic signs positioned next to the road, over a portion of the traffic lanes, or overhead each traffic lane. In certain embodiments, the electronic signs may be displayed on a gantry extending over a portion of the roadway. Variable speed signs (VSS) are an important component of automotive cloud technology and highly assisted driving (HAD) technology. Vehicles may have high definition cameras and/or advance radar systems that can read the displayed value on VSS from a distance away. After the VSS speed is read by the camera or radar system, the current travel speed is checked and an alert can be provided to the driver if the vehicle speed surpasses the VSS value read by the camera for the current lane of travel. VSS speed values may be variable and a function of one or more of weather, traffic, time of day, day of week, construction, or other factors.

For example, weather related VSS may be used on roads where fog, ice, rain, snow, or other factors may influence safety. When weather conditions deteriorate visibility to the point that hazardous conditions are impending, the operating agency may adjust (e.g., reduce) the speed limit to help minimize the likelihood of a traffic accident. Traffic congestion related VSS may be used when traffic volumes are building and congestion is likely. When volumes and/or speed exceed a predetermined threshold, an operational strategy may be deployed to handle more traffic volume at a reduced, but not stop-and-go, speed.

In the case of construction related VSS, a long construction zone may often have actual construction occurring in only short segments of the zone. In addition, construction zones may be signed using static speed limit signs as if construction activity occurs throughout the entire day on each and every day. In reality, the intensity, duration, and location of construction activity may vary throughout the construction zone depending on the extent of work being performed. Providing more accurate and real time speed restrictions using VSS based on the level of construction activity may provide more accurate information to motorists and allow drivers to comply with the posted regulatory speed while improving safety in the construction zone. Adjusting (e.g., reducing) vehicle speed limits in active construction zones may improve safety for drivers and construction workers and may reduce the number and/or severity of accidents that occur in the zone.

There are several shortcomings with relying on visual detection such as camera for VSS display value detection. For example, a vehicle's camera may confuse 50 km/h with 80 km/h. In some instances, the vehicle operator may be incorrectly warned, which may impede on the operator's safety. In addition, applications that rely on a direct line of sight to the VSS cannot read the displayed values in certain low visibility situations. For example, heavy rain may occlude the VSS, and a vehicle behind a truck or trailer may not have line of sight to the VSS. Furthermore, most cars do not have front camera or radar system and cannot automatically read the VSS. In other words, the penetration ratio or percentage of cars with camera or video technology that are equipped to read a VSS display is low. Without camera technology vehicles may not be aware of a VSS displayed value from miles or fraction of a mile before the VSS. Subsequently, drivers cannot adjust their speeds timely.

The following embodiments include systems, methods, and apparatuses for determining the speed value displayed on a variable speed sign (VSS). Based on the speed value, the vehicle's navigation system may (1) alert the driver of any difference in operating speed from the predicted variable speed limit, or (2) adjust the speed of the vehicle to approximate the predicted variable speed limit. The scope of this system, method, and/or apparatus is described in further detail herein.

FIG. 1 illustrates an example system 120 for reporting and processing speed sign values from a vehicle 124. The system 120 includes a developer system 121, one or more mobile devices 122, a workstation 128, and a network 127. Additional, different, or fewer components may be provided. For example, many mobile devices 122 and/or workstations 128 connect with the network 127. The developer system 121 includes a server 125 and one or more databases. Database 123*a* may be a probe database that stores probe data, which may include both historical and real data. Database 123*b* may be a geographic database including road links or segments.

The server 125 is configured to identify a variable speed sign. For example, the geographic database 123*b* may include geographic locations of multiple variable speed signs. The server 125 may receive a location value and select the variable speed sign based on the location value. The location values may be received from a navigation application (e.g., current position of a user) or from a mapping application (e.g., selected position from a user).

The server 125 receives probe data collected at a plurality of vehicles by mobile devices 122. The probe data includes a location indicator that describes the location at which the probe data was collected. The probe data includes the speed at which the mobile device 122 was traveling when the probe data was collected. Alternatively, the prove data may include position data, and the server 125 may calculate speed from the position data.

The server 125 identifies a subset of the probe data that is associated with the selected variable speed sign. The server 125 performs a statistical analysis on the probe data. The statistical analysis may include a K medoid analysis or another clustering technique. The statistical analysis estimates the likely speed limit based on the speeds from the probe data. The server 125 stores the estimated speed limit value for the variable speed sign and reports the estimated speed limit value. For example, the speed limit value may be sent to another mobile device 122. The mobile device 122 may issue warnings when a current speed exceeds the speed limit value. The mobile device 122 may be a highly assisted driving (HAD) vehicle or autonomous vehicle that controls a speed of a vehicle according to the speed limit value. Additional embodiments and details are discussed below.

The navigation device 122 may be a personal navigation device ("PND"), a portable navigation device smart phone, a mobile phone, a personal digital assistant ("PDA"), a tablet computer, a notebook computer, and/or any other known or later developed mobile device or personal computer. Non-limiting embodiments of navigation devices may also include relational database service devices, mobile phone devices, or car navigation devices.

The developer system 121, the workstation 128, and the navigation device 122 are coupled with the network 127. The phrase "coupled with" is defined to mean directly connected to or indirectly connected through one or more intermediate components. Such intermediate components may include hardware and/or software-based components.

The workstation 128 may be a general purpose computer including programming specialized for providing input to the server 125. For example, the workstation 128 may provide settings for the server 125. The settings may include a value for the predetermined interval that the server 125 requests the navigation device 122 to relay current geographic locations. The workstation 128 may be used to enter data indicative of GPS accuracy to the database 123. The workstation 128 may include at least a memory, a processor, and a communication interface.

The computing resources may be divided between the server 125 and the navigation device 122. In some embodiments, the server 125 performs a majority of the processing for calculating the vehicle confidence value and the comparison with the confidence threshold. In other embodiments, the computing device 122 or the workstation 128 performs a majority of the processing. In addition, the processing is divided substantially evenly between the server 125 and the computing device 122 or workstation 128.

Figure 2:
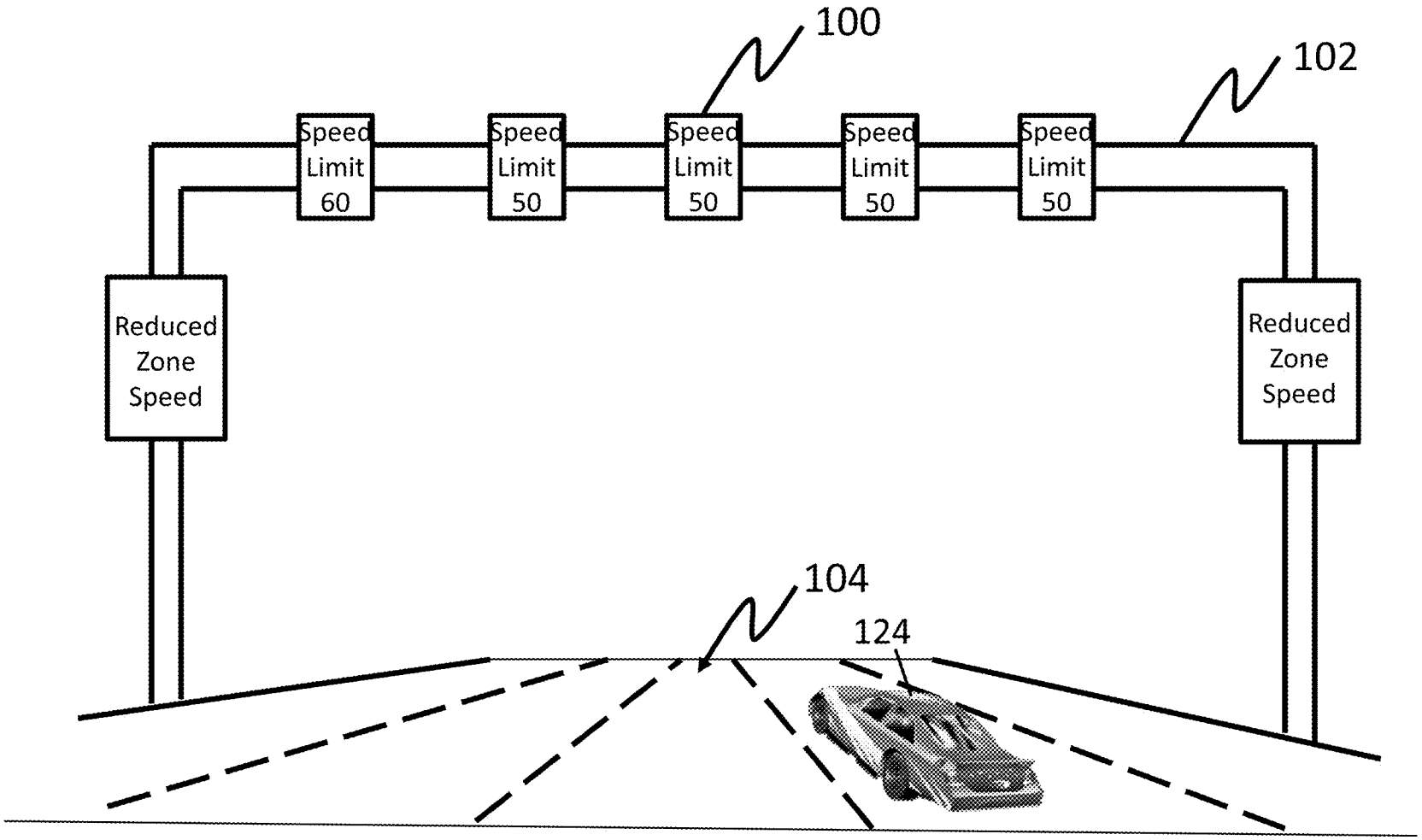
FIG. 2 illustrates an example gantry displaying a plurality of variable speed signs.

FIG. 2 illustrates an embodiment of a VSS display, wherein a number of electronic signs 100 are connected to a gantry 102 and displayed over traffic lanes 104 of a roadway. As depicted in FIG. 2, an electronic sign is positioned over each traffic lane to display the actual speed limit value for the traffic lanes 104 or for individual traffic lanes.

In other embodiments, a single electronic sign may be positioned over one of the traffic lanes, or on the side of the road next to the traffic lanes. In yet other embodiments, a plurality of electronic signs less than the total number of traffic lanes may be positioned over or next to a portion of the traffic lanes of the roadway.

In certain embodiments, the electronic sign(s) may include variable speed limit values. The signs may also include additional text such as "CAR" or "TRUCK," to provide additional information regarding which vehicles the displayed speed limit value pertains (e.g., the variable speed limit value for a car could be 60 while the speed limit value for a truck could be 50).

Figure 3:
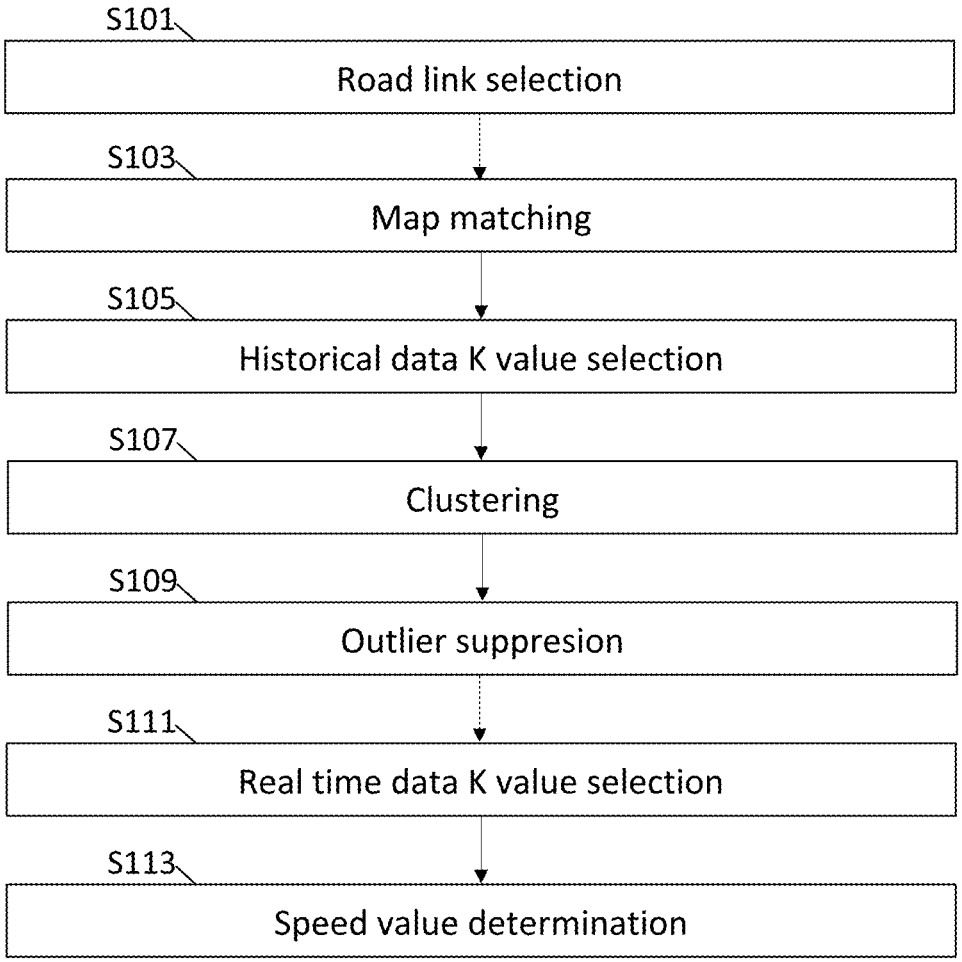
FIG. 3 illustrates an example flow chart for determining speed values for a variable speed sign.

FIG. 3 illustrates an example flow chart for determining speed values for a variable speed sign. The acts in FIG. 3 may be performed at the server 125 or a mobile device 122. Additional, different, or fewer components may be used.

At act S101, a road link or road segment associated with the VSS is selected. The locations of the VSS may be provided as a text file. The selection of relevant road links for a candidate VSS could be based on distance between the VSS and the road link and direction of travel of the road link. In one example, the mobile device 122 may generate location data indicative of the current location of the mobile device 122 and send the location data to the server 125, which queries the geographic database 123*b* for the appropriate road segment. In another example, the mobile device 122 may initially identify the road segment and send data indicative of the road segment to the server 125. Alternatively, the road segment may be selected independent from the physical location of the mobile 122. For example, a user may select a particular location on a map or a route may be calculated that includes multiple road segments.

Any of these locations may be describes as a point or coordinate pair (e.g., longitude and latitude) or a region such as a polyline or bounding box. The region may correspond to a route, a neighborhood, or a town. The region may be selected manually by drawing the polyline.

The server 125 may select multiple road segments based on the geographic location. The road segments may be road segments that are downstream (i.e., the direction of traffic) of the VSS. The server 125 may select a predetermined number of road segments or the road segments that are a predetermined distance downstream of the location of the VSS or location received from the mobile device 122. The predetermined number of road segments and/or the predetermined distance may be configurable based on a configurable value. The configurable value may be set at different levels for different geographic regions. For example, configurable value may cause more road segments to be included in rural areas and fewer road segments to be included in urban areas. The configurable value may be specified for particular roads or particular cities. The configurable value may be set according to time of day or the day of the week. The configurable value may be a range (e.g., the number of selected road segments is more than X and less than Y).

At act S103, the server 125 or mobile device 122 performs map matching. The inputs to map matching include the road segments from act S101 and probe data collected by multiple mobile devices 122 traveling along the road segments. The probe data that corresponds to the selected road segments are identified as the initial probe data set. The initial probe data may be divided according to lane. The probe data may be selected over a historical time period (e.g., a week, a month, or all available data). The probe data may be collected by various devices or sensors. The mobile devices 122 may include position circuitry (e.g., global positioning system sensor) or other sensors described with respect to FIG. 4 below.

At act S105, the server 125 determines a quantity for K values based on the initial probe data set. The server 125 may calculate a statistical parameter such as standard deviation or variance. The server 125 may query a lookup table that associates the statistical values with K values. As shown in table, 1 a first K value ($K_1$) is selected when the initial probe data is tightly distributed when the standard deviation is low, a second K value ($K_2$) is selected when the standard deviation is at a medium level, and a third K value ($K_2$) is selected when the standard deviation is at a high level. Act S105 may be performed separately for each lane of the road segment.

TABLE 1

| Standard Deviation ($\sigma$) | K value |
|---|---|
| $\sigma < \sigma_1$ | $K_1$ |
| $\sigma_1 \leq \sigma < \sigma_2$ | $K_2$ |
| $\sigma \geq \sigma_2$ | $K_3$ |

Table 2 lists an example lookup table for assigning K values to the initial probe data. The K value increases as the standard deviation increases. The K value may be a function of the standard deviation. The K value may be linearly proportional to the standard deviation. The standard deviation may have units of speed or velocity such as miles per hour, kilometers per hour (kph), meters per second or another unit. The example in Table 2 may be in kph. When the standard deviation less than 20 kph, the K value is 3, when the standard the standard deviation is between 20 and 30 kph, the K value is 4, and when the standard deviation is greater than 30 kph, the K value is 5.

TABLE 2

| Standard Deviation ($\sigma$) | K value |
|---|---|
| $\sigma < 20$ | 3 |
| $20 \leq \sigma < 30$ | 4 |
| $\sigma \geq 30$ | 5 |

At act S107, the server 125 performs clustering based on the K value. The K value may determine the number of clusters used. The Clustering may be K medoid clustering. Act S107 may be performed separately for each lane of the road segment.

First, the server 125 initializes the clustering process for the historical probe data. The server 125 selects a probe point for each of the K values to act as the initial medoids. The initial medoids may be selected randomly or may be selected according to the ordered set of initial probe data (e.g., for example when K=3, select points at or near the $1^{st}$, $2^{nd}$, and $3^{rd}$ quartiles). The server 125 then calculates a distance from each of the points in the initial data set to each of the medoids in order to assign a closest medoid to each of the data points. The distance may be a Euclidean distance or another measure of distance. Then, for each medoid ($m_i$) and for each non-medoid probe point (x), the server 125 swaps the non-medoid probe point (x) and the medoid ($m_i$) and computes the total distances for the new configuration. This is repeated for each cluster ($C_i$). For each iteration, the server 125 selects the configuration with the lowest cost, as shown by Equation 1.

$$\text{Cost} = f(x, m) = \min\left(\sum_{i=1}^{K} \sum_{x \in C_i} d(x, m_i)\right) \quad \text{Eq. 1}$$

This process is repeated until further iterations do not improve the total distance. The medoids at this point are set as the as the centroid for the K quantity of clusters. These medoids, which are centroids of the clusters, are actual data points from the data set, as opposed to average values of the clusters as used in K-means clustering.

At act S109, the server 125 identifies and suppresses outliers. The outliers are data points that may have been caused by anomalous driving behavior. Anomalous driving behavior may include extreme speeders, emergency vehicles, or vehicles that are slowed because of a flat tire or other malfunction. For example, an intoxicated driver may drive 200 kph on a road link however this is not the typical behavior and may form outlier clusters that should be identified and pruned or removed from the data used by the system.

One technique for removing outliers may compare the top two clusters. The server 125 identifies the sizes (quantity of data points) for the top two clusters. When the top most speed cluster is smaller than the second most speed cluster, then the top most speed cluster is identified as an outlier and removed from the data. If the top most speed cluster includes more data points than the second most speed cluster, no outliers are identified. After any potential outliers have been removed (e.g., by removing the top cluster), the remaining clusters represent bands of possible speed limits for the road segments. Each of the centroid values may be stored as a possible speed limit value. Thus, the server 125 stores a set of possible speed limit values based on the K-medoid clustering of historic probe data. Act S109 may be performed separately for each lane of the road segment.

At act S111, the server 125 analyzes real time data using K values. The real time data is probe data collected by mobile device 122 in a recent time period. The recent time period is a non-historical time period such as the most recent minute, 15 minutes, or hour. The time period should be selected to be smaller than a typical interval of the VSS. The real time data is clustered using K medoid clustering, K means clustering, or another technique.

Thus, for K medoid clustering, the server 125 first initializes the clustering process for the real time probe data. The server 125 selects a probe point for each of the K values to act as the initial medoids. The initial medoids may be selected randomly or may be selected according to the ordered set of initial probe data. The server 125 then calculates a distance from each of the points in the initial data set to each of the medoids in order to assign a closest medoid to each of the data points. The distance may be a Euclidean distance or another measure of distance. Then, for each medoid and for each non-medoid probe point, the non-medoid probe point and the medoid are switched, and the total distances for the new configuration are computed. For each iteration, the server 125 selects the configuration with the lowest cost. This process is repeated until further iterations do not improve the total distance. The medoids at this point are set as the as the centroid for the K quantity of clusters.

Outliers may be removed from the clustered real time probe data. The outliers may be identified from a sparsely populated highest speed cluster. For example, when the top most speed cluster is smaller than the second most speed cluster, then the second most speed cluster is used to select the representative of the speed of the vehicles, and when the top most speed cluster is larger than the second most speed cluster, then the top most speed cluster is used to select the representative of the speed of the vehicles.

At act S113, the server 125 determines a speed value by comparing the cluster from act S111 with the most data points to the set of possible speed values stored in act S109. The speed value for the medoid having the most data points may be referring to as the winning medoid. The server 125 performs a nearest neighbor approximation using the winning medoid. The server 125 compares the winning medoid to the previously determined set of possible speed limit values, and identifies the closest speed limit in the set of possible speed limit values stored in act S109 as the representative speed value for the VSS for the current time period or representative time period. The server 125 may store the representative speed value for the VSS and associate the representative speed value with the selected VSS from act S101. The representative speed value may be sent to mobile devices 122. The representative speed value may be send to mobile devices other than the mobile devices that submitted the probe data. The representative speed value may be sent to vehicles that are approaching the VSS.

Consider a representative example in which L is the set of possible speed values (e.g., L={80,100,120} OR L={60,80} OR L={40,60,80} OR L={120}). P represents a set of probe speeds obtained from one or more road segments downstream to the VSS. The number of K values is determined as a function of the standard deviation of P (e.g., according to Table 1, Table 2, or another example). The K medoid algorithm is executed on set P (e.g., using the PAM( ) or CLARAN( ) Algorithms). Let R (m,c), where m=medoid and c=cluster size, be a two dimensional array of set that contains the results obtained from the K medoid clustering algorithm (e.g., R(m,c)=PAM(P,K)). R may be sorted as a function of m (using the medoids speed values) to select the top two ranked medoids. From those top two medoids, the largest medoid is selected and compared to set L to identify the predicted speed limit.

Figure 4:
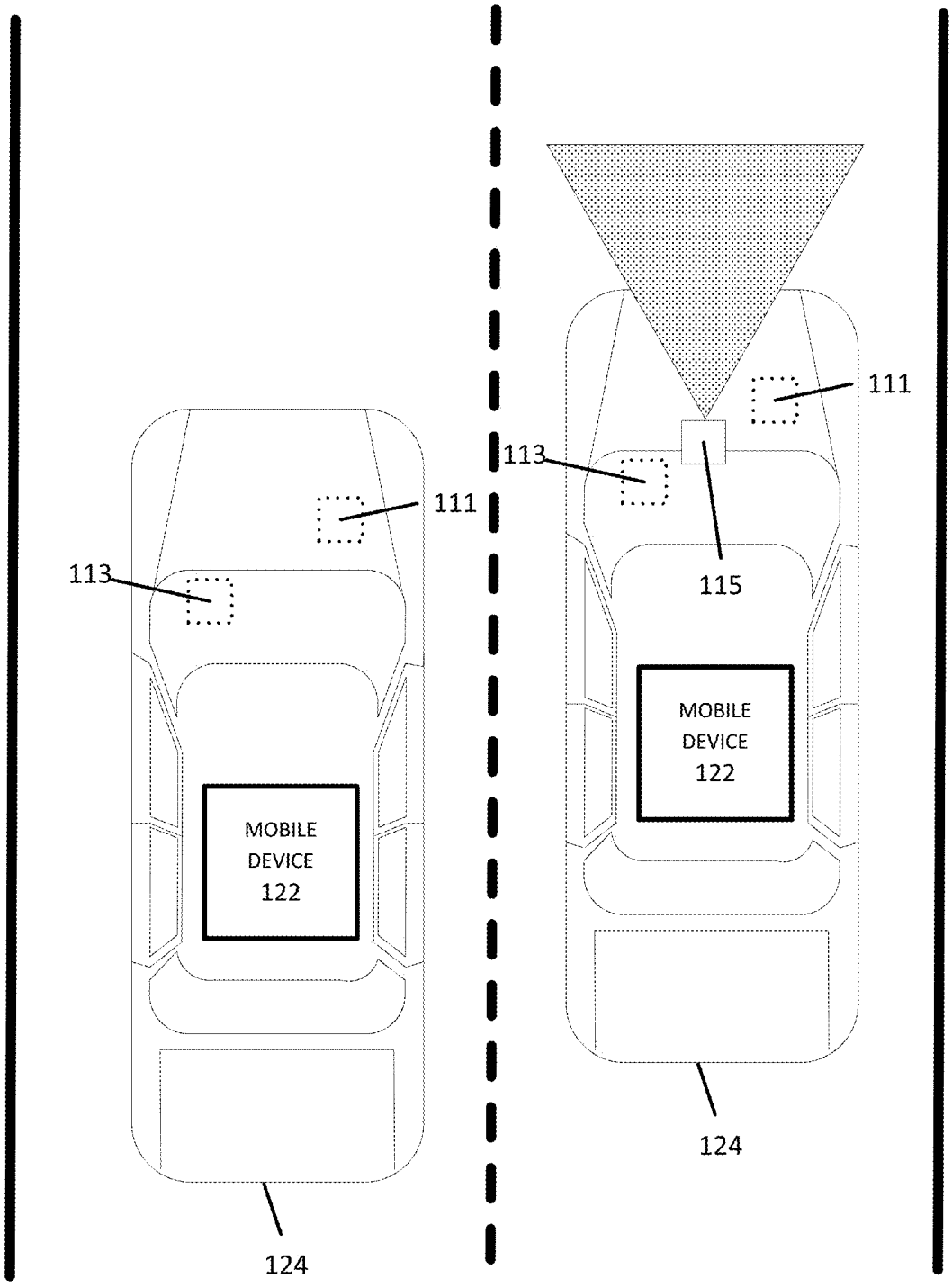
FIG. 4 illustrates example vehicles from the system of FIG. 1.

FIG. 4 illustrates example vehicles 124*a-b* from the system of FIG. 1. The vehicles 124*a-b* may be autonomous vehicles. The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes.

A highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible.

The vehicles 124*a-b* include position circuitry such as a dead reckoning-type system, cellular location, or combinations of these or other systems. The positioning circuitry may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer built or embedded into or within the interior of the mobile device 122. The accelerometer is operable to detect, recognize, or measure the rate of change of translational and/or rotational movement of the mobile device 122. The mobile device 122 receives location data from the positioning system. The location data indicates the location of the mobile device 122. The position circuitry may be included in the mobile device 122 or in another module of the vehicle.

In addition, the autonomous or highly automated driving vehicle may include sensors for identifying the surrounding and location of the car. The sensors may include light detection and ranging (LIDAR), radar, and cameras for computer vision. Proximity sensors may aid in parking the vehicle. The proximity sensors may detect the curb or adjacent vehicles. The autonomous or highly automated driving vehicle may optically track and follow lane markings or guide markings on the road.

One additional example, an engine sensor 111, may include throttle sensor that measures a position of a throttle of the engine or a position of an accelerator pedal, a brake senor that measures a position of a braking mechanism or a brake pedal, or a speed sensor that measures a speed of the engine or a speed of the vehicle wheels. Another additional example, vehicle sensor 113, may include a steering wheel angle sensor, a speedometer sensor, or a tachometer sensor. Another additional and optional example, vehicle sensor 115 may be a camera, a light detection and ranging (LIDAR) sensor, a radar sensor, or an ultrasonic sensor. The vehicle sensor 115 may determine road status such as the shape or turns of the road, the existence of speed bumps, the existence of pot holes, the wetness of the road, or the existence or ice, snow, or slush. The vehicle sensor 115 may be programmed to identify a VSS and read or capture the displayed speed limit value. In some embodiments, the sensor 115 may be programmed to read or capture the displayed speed limit value of a VSS positioned on an overhead gantry above the same traffic lane as the vehicle. In other embodiments, the sensor 115 may be programmed to read or capture the displayed speed limit value of a VSS positioned on a gantry above a separate traffic lane or along the side of the road if no VSS is positioned above each traffic lane. In yet other embodiments, the sensor 115 may be programmed to read or capture additional text on the VSS such as "CAR" or "TRUCK." To the extent the vehicle 124 is a car, the sensor 115 may be programmed to further process a speed limit value associated with a VSS labeled "CAR." To the extent the vehicle 124 is a truck, the sensor 115 may be programmed to further process a speed limit value associated with a VSS labeled "TRUCK." The results of the speed value determination in FIG. 3 (e.g., act S113) may be compared with the determination from the sensor 115 to confirm or check each other.

Figure 5:
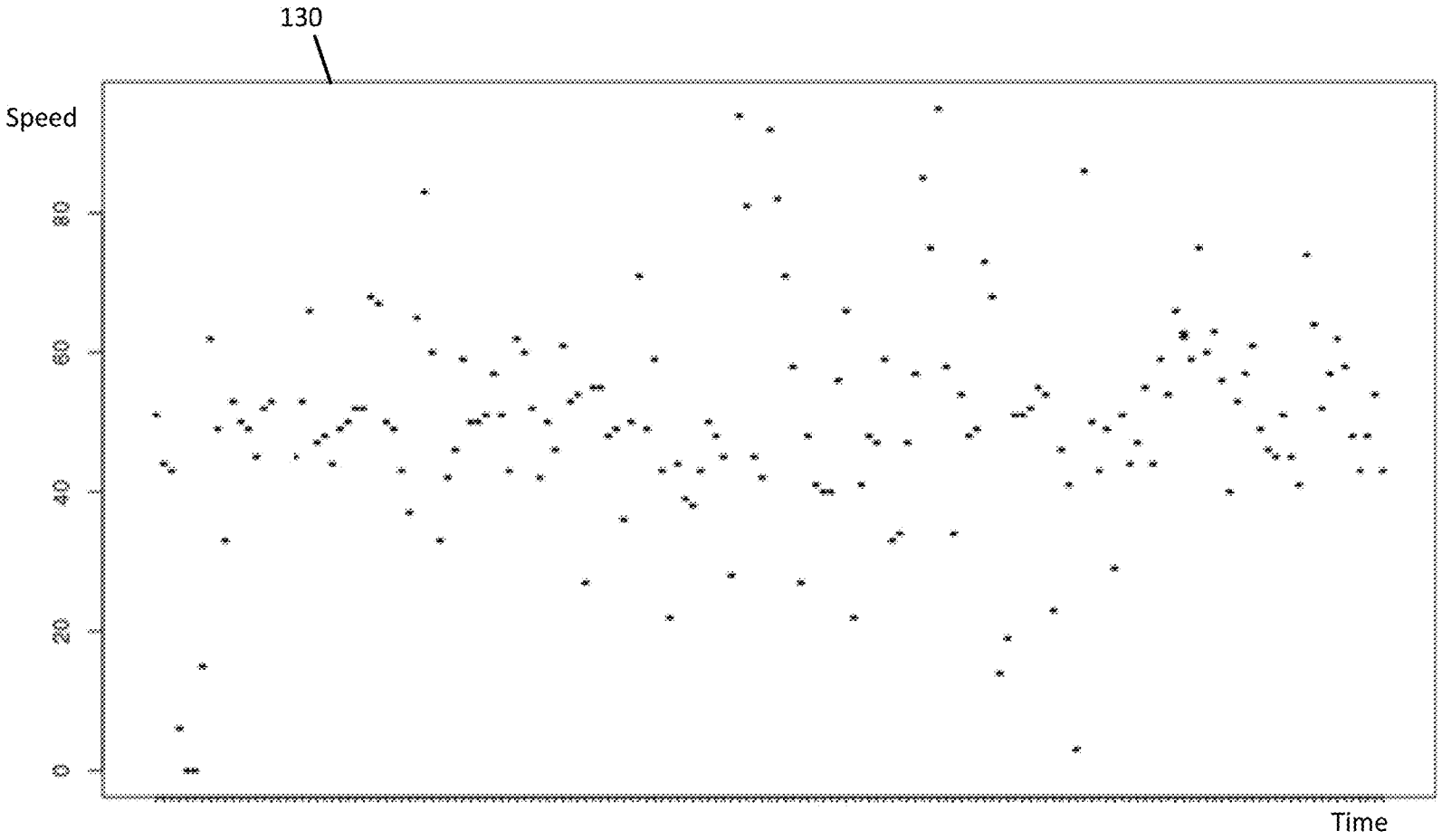
FIG. 5 illustrates example probe data from the vehicles of the system of FIGS. 1 and 4.

FIG. 5 illustrates a chart 130 of example probe data from the vehicles of the system of FIGS. 1 and 4. The vertical axis of chart 130 represents speed or distance per unit time. The horizontal axis of chart 130 represents time. The probe data may include historical probe data, recent probe data, or both recent and historical probe data. In one example, recent probe data includes the probe data indicative of a single speed value setting for the VSS and historical probe data includes prove that spans multiple speed value settings for the VSS over time. Alternatively, recent probe data may have been collected for a first time period and the historical probe data may have been collected over a second time period such that the first time period is less than the second time period. The first and second time periods may not overlap.

Figure 6:
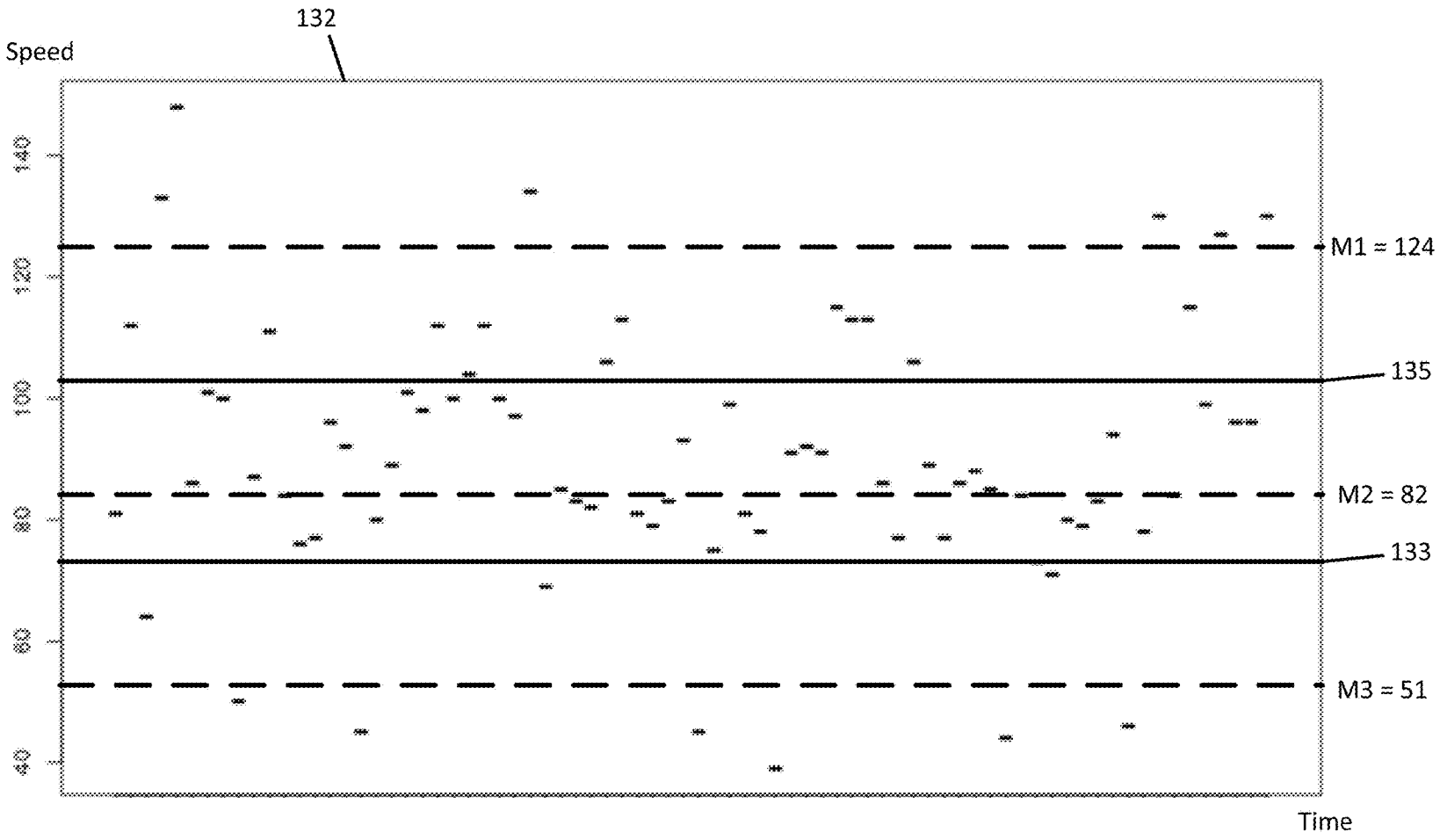
FIG. 6 illustrates example probe data from the vehicles of the system of FIGS. 1 and 4.

FIG. 6 illustrates a chart 132 example probe data from the vehicles of the system of FIGS. 1 and 4. The vertical axis of chart 132 represents speed or distance per unit time. The horizontal axis of chart 132 represents time. The probe data in chart 132 has been divided into three clusters according to a K medoid clustering. For example, a standard deviation for the speed data may have been calculated within a predetermined range, which corresponds to K=3 in Tables 1 and 2 above. The data points with speeds higher than solid line 135 are in a first cluster having a median or centroid value (M1) of 124 kph or another speed unit, the data points between solid line 135 and solid line 133 are in a second cluster having a median or centroid value (M2) of 82 kph or the other speed units, and the data points with speeds less than solid line 133 are in a third cluster having a median or centroid value (M3) of 51 kph or the other speed units. The data of chart 132 may be historical probe data used to define possible speed values (possible VSS values that change over time) that are stored and later compared with recent probe data, or, the data of chart 132 may include the recent probe data that is analyzed to determine the winning medoid used to select the speed limit value.

As used herein, the terms "actual speed limit value" and "actual speed sign value" may refer to the actual posted speed sign value on a variable speed sign. The actual value is attempted to be estimated and/or verified by the systems, methods, and apparatuses described herein. As used herein, the terms "predicted speed limit value" and "estimated speed limit value" may refer to the speed sign value determined from the compilation of interpreted and/or analyzed probe data from the plurality of vehicles.

Figure 7:
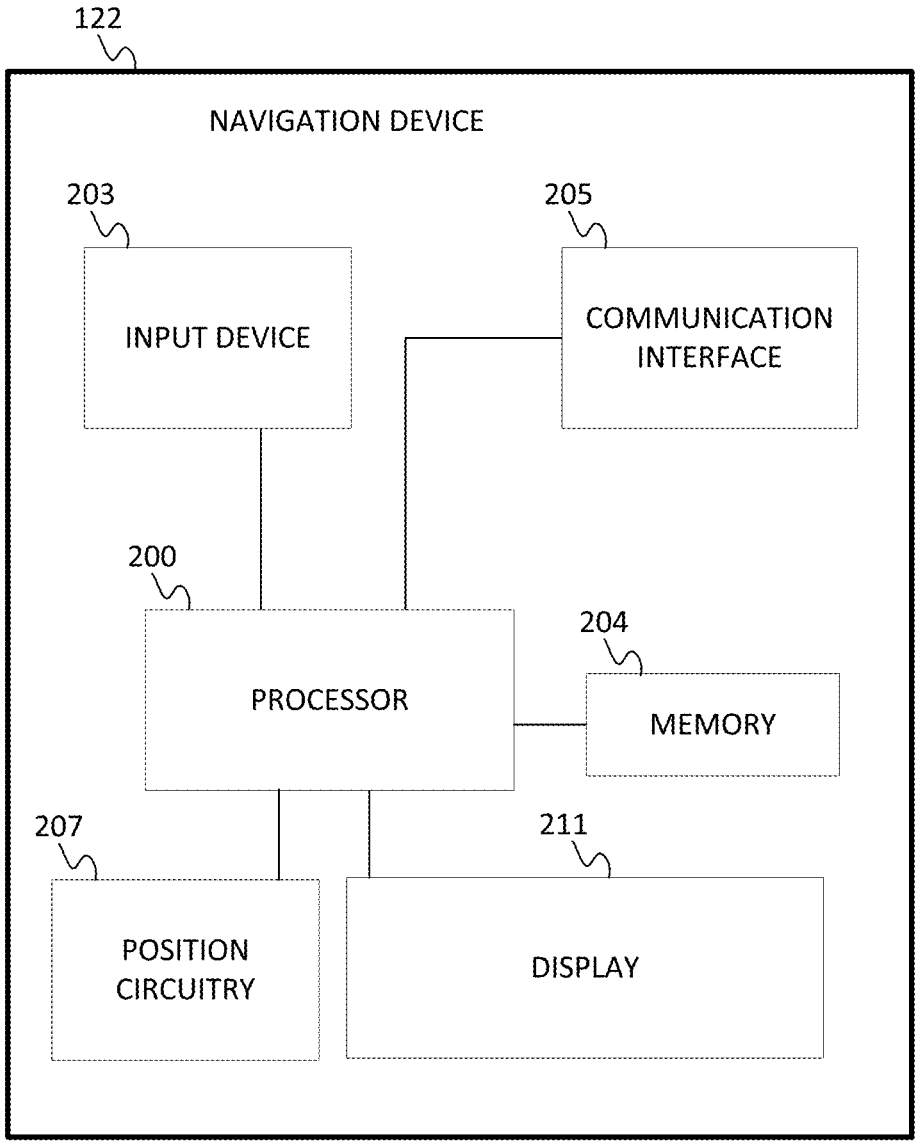
FIG. 7 illustrates an example navigation device of the system of FIG. 1.

FIG. 7 illustrates an exemplary navigation device 122 of the system of FIG. 5. The navigation device 122 includes a processor 200, a memory 204, an input device 203, a communication interface 205, position circuitry 207, and a display 211. Additional, different, or fewer components are possible for the mobile device/personal computer 122.

The processor 200 may be configured to receive data indicative of the location of the navigation device 122 from the position circuitry 207. The positioning circuitry 207, which is an example of a positioning system, is configured to determine a geographic position of the navigation device 122. The positioning system may also include a receiver and correlation chip to obtain a GPS signal. The positioning circuitry may include an identifier of a model of the positioning circuitry 207. The processor 200 may access the identifier and query a database or a website to retrieve the accuracy of the positioning circuitry 207 based on the identifier. The positioning circuitry 207 may include a memory or setting indicative of the accuracy of the positioning circuitry.

Figure 8:
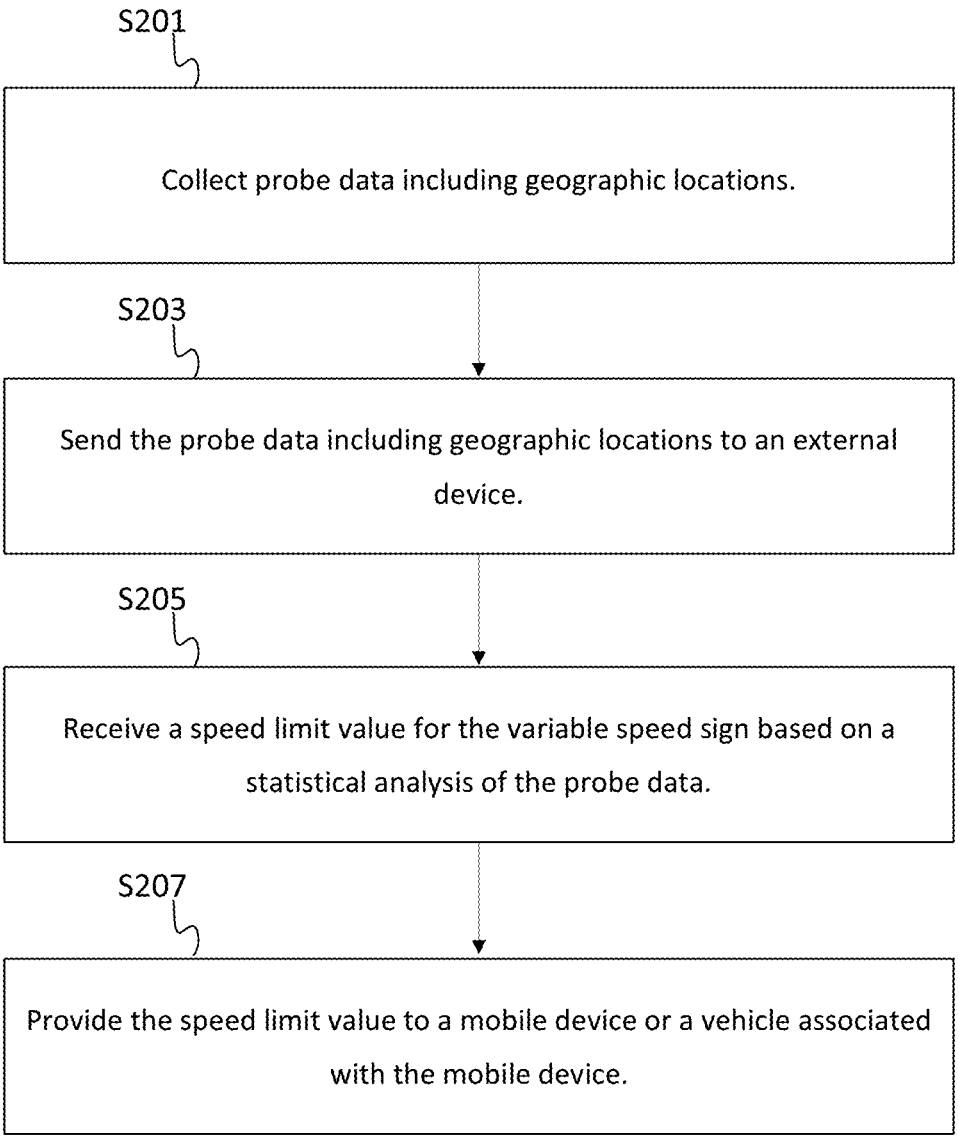
FIG. 8 illustrates an example flowchart for determining speed values for a variable speed sign.

FIG. 8 illustrates an example flowchart for determining speed values for a variable speed sign. The acts of the flowchart of FIG. 8 may be performed by a mobile device, an advanced driving assistance system (ADAS), a HAD device or an autonomous vehicle, any of which may be referred to as a computing device. Different, fewer, or additional acts may be included.

At act S201, probe data is collected by one or more computing devices traveling along one or more road segments. The probe data may be collected by position circuitry 207. The probe data may be continuously collected or collected only in response to a command, either from the local use of the computing device or from a server. In one example, the computing device includes an application with permission to activate probe data collection in response to a command from the server. In one example, the server may identify potential changes in the VSS and activate prove data collection in response.

The probe data may include only location data with timestamps. The probe data may be collected downstream of a VSS. In one example, the probe data is organize by VSS such that a database of probe data indexes the probe data according to road segments including a VSS or downstream of the VSS. The probe data may be indexed based on individual lanes of the road segments.

At act S203, the probe data is sent to an external device. The external device may be a server (e.g., server 125) or a central vehicle computer in communication with the computing device. The location data and time may be manipulated to calculate the speed of the computing device. In one example, the probe data is stored by the computing device and later download for analysis to the external device. The external device may perform a statistical analysis, such as K medoid clustering on the probe data.

In one example, when the probe data is part of historical probe data, a historical statistical analysis is performed. In the historical statistical analysis the statistical analysis bands of possible speed limit values over time. For example, the historical probe data may have clusters around a low speed limit value (e.g., 30 mph) designed to regulate stop and go traffic, a medium speed limit value (e.g., 55 mph) for normal traffic flow, and a high speed limit value (e.g., 70 mph) used at off peak times such as overnight. The historical statistical analysis may identify and store a set of possible speed limit values including the low speed limit value, the medium speed limit value, and the high speed limit value.

In another example, when the probe data is part of recent probe data, a real time statistical analysis is performed. In the real time statistical analysis, current or substantially real time (e.g., within a recent predetermined time period such as 1 minute or 15 minutes), the recent probe data is analyzed using clustering to determine which of the low speed limit value, the medium speed limit value, and the high speed limit value is likely to be representative of the recent probe data.

At act S205, the computing device receives a speed limit value from the external device. The speed limit value may be the low speed limit value, the medium speed limit value, and the high speed limit value. The speed limit value may be received through a cellular connection, wireless Internet connection, or direct communication with the external device. The speed limit value may be broadcast to multiple computing devices in addition to the computing devices that collected probe data. That is, a first set of mobile devices may collect the probe data and a second set of mobile devices may receive the speed limit value. The second set may include the first set, the second set may be mutually exclusive of the first set, or the second set may partially overlap the first set.

At act S207, the computing device provides the speed limit value. In one example, the speed limit value is provided to the user by displaying the speed limit value on a screen (e.g., display 211). In another example, the speed limit value is provided to a navigation application, which may be internal or external to the mobile device, and the navigation application compares the current speed of the vehicle to the speed limit value. When the current speed exceeds the speed limit value, the navigation application may generate a speed warning to the user. In another example, the speed limit value is provided to a driving assistance application, which may be internal or external to the mobile device, and the driving assistance application may be configured to generate a driving command to modify the operation of the vehicle based on the speed limit value. For example, the driving command may instruct the vehicle (e.g., an engine control unit) to increase the throttle, decrease the throttle, apply more braking force, apply less braking force, or another driving function in response to the predicted or estimated speed limit value.

In another example, at act S205, the computing device receives the speed limit value for the current lane of the vehicle as well as the speed limit values from other lanes of the current road segment from the external device. The computing device may compare the possible speed limit values and identify the lane with the highest speed limit value to the user. The navigation application may determine whether or not to instruct the user to change lanes based on a current route (e.g., whether or not the route include an exit within a certain distance) and the speed limit values from other lanes. In another example, the driving assistance application may steer the vehicle to another lane based on the speed limit values from other lanes.

Figure 9:
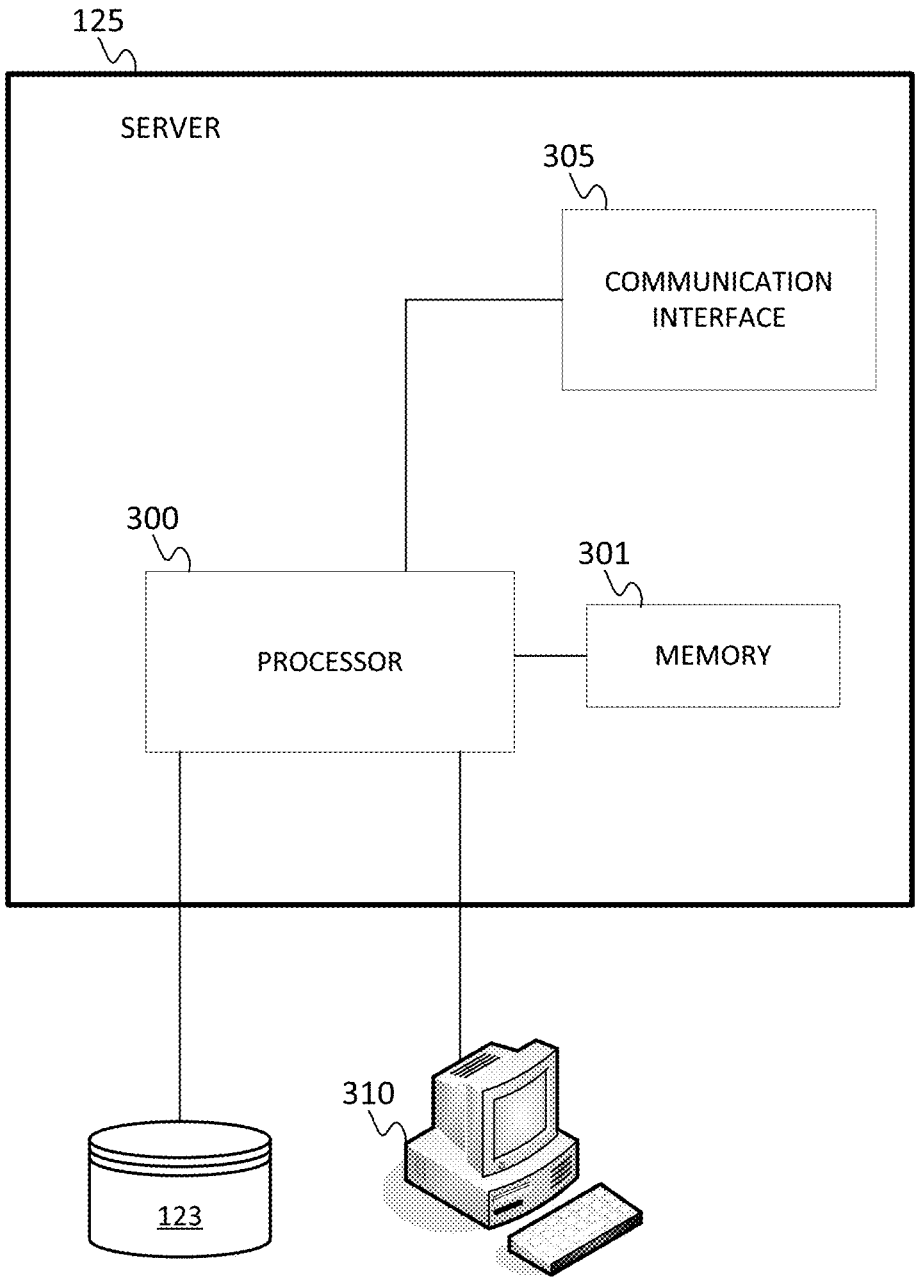
FIG. 9 illustrates an example network device of the system of FIG. 1.

FIG. 9 illustrates an exemplary server 125 of the system of FIG. 1. The server 125 includes a processor 300, a communication interface 305, and a memory 301. The server 125 may be coupled to a database 123 and a workstation 128. The workstation 128 may be used as an input device for the server 125. In addition, the communication interface 305 is an input device for the server 125. In certain embodiments, the communication interface 305 may receive data indicative of user inputs made via the workstation 128 or the navigation device 122.

The computing device processor 200 and/or the server processor 300 may include a general processor, digital signal processor, an application specific integrated circuit (ASIC), field programmable gate array (FPGA), analog circuit, digital circuit, combinations thereof, or other now known or later developed processor. The navigation device processor 200 and/or the server processor 300 may be a single device or combinations of devices, such as associated with a network, distributed processing, or cloud computing. The computing device processor 200 and/or the server processor 300 may also be configured to cause an apparatus to at least perform at least one of methods described above.

The server processor 300 may be configured to identifying a variable speed sign based on a current location or from locations in probe data collected near or downstream of the variable speed sign. The server processor 300 may be configured to perform a statistical analysis on the probe data and select a speed limit value for the variable speed sign based on the statistical analysis. The statistical analysis may include the selection of a medoid factor based on a standard deviation of the probe data, clustering of the probe data, and the identification of centroids from the clustering. The centroids may be stored in memory 301 as a set of possible speed limit values. The server processor 300 may be configured to perform a second statistical analysis on newer or recent probe data. One or more of the set of possible speed limit values may be selected based on the second statistical analysis.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the navigation device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

In the above described embodiments, the network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term "circuitry" or "circuit" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., E PROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method comprising:

receiving historical probe data collected by position circuitry from a plurality of vehicles traveling along a roadway associated with at least one variable speed sign;

map matching the historical probe data to at least one road segment;

calculating a statistical value for the historical probe data;

performing a comparison of the statistical value to one or more thresholds;

selecting a plurality of K values in response to the comparison, the plurality of K values corresponding to a plurality of bands of possible speed limits for the roadway set by the at least one variable speed sign;

receiving real time probe data for the roadway;

assigning the real time probe data to the plurality of K values;

selecting a final cluster based on an amount of the assigned real time probe data;

calculating a speed limit from the plurality of bands of possible speed limits for the roadway set by the at least one variable speed sign based on the final cluster; and sending the speed limit to at least one approaching vehicle approaching the at least one variable speed sign, wherein a display device of the at least one approaching vehicle warns the user based on the speed limit or an engine control unit generates a command for the at least one approaching vehicle based on the speed limit.

2. The method of claim 1, wherein the probe data includes probe data for a plurality of lanes of the roadway.

3. The method of claim 2, wherein the plurality of lanes includes a first lane that corresponds to a first K value of the plurality of K values and a second lane that corresponds to a second K value of the plurality of K values.

4. The method of claim 1, wherein the statistical value is a standard deviation, and the one or more thresholds include a first threshold that corresponds to a low standard deviation and a second threshold that corresponds to a high standard deviation.

5. The method of claim 1, wherein selecting the plurality of K values comprises:

reducing a number of clusters assigned to the historical probe data; and determining the plurality of bands of possible speed limits for the roadway based on centroids of the number of clusters assigned to the historical probe data.

6. The method of claim 1, wherein the at least one road segment includes a plurality of road segments downstream of the at least one variable speed sign.

7. The method of claim 1, further comprising:

selecting a plurality of initial medoid values; and switching at least one of the initial medoid values with a non-medoid point in the historical probe data, wherein the plurality of K values corresponds to the switched medoid values.

8. The method of claim 1, further comprising:

removing data from the historical probe data based on anomalous driving behavior detected in the historical probe data.

9. The method of claim 8, wherein the anomalous driving behavior includes speeding vehicles, emergency vehicles, or malfunctioning vehicles.

10. The method of claim 1, wherein the at least one variable speed sign includes a plurality of variable speed signs corresponding to different lanes of the roadway.

11. A navigation device for a vehicle, the navigation device comprising:

position circuitry configured to collect real time data for a position of the vehicle on a roadway; and a communication interface to send the real time data for the position of the vehicle to an external device and receive from the external device a speed limit value, wherein the speed limit value is calculated from a plurality of bands of possible speed limits set by the at least one variable speed sign based on historical probe data for the roadway and assigned to a plurality of K values for the historical probe data.

12. The navigation device of claim 11, further comprising:

a display configured to provide an alert in response to the speed limit value.

13. A non-transitory computer readable medium including instructions that when executed on a computer are operable to perform:

receiving historical probe data collected by position circuitry from a plurality of vehicles traveling along a roadway associated with a variable speed sign;

map matching the historical probe data to at least one road segment;

calculating statistical value for the historical probe data;

performing a comparison of the statistical value to one or more thresholds;

selecting a plurality of K values in response to the comparison, the plurality of K values corresponding to a plurality of bands of speed limits for the roadway set by the at least one variable speed sign;

receiving real time probe data for the roadway;

assigning the real time probe data to the plurality of K values;

selecting a final cluster based on an amount of the assigned real time probe data;

calculating a speed limit from the plurality of bands of speed limits based on the final cluster; and sending the speed limit to at least one mobile device approaching the variable speed sign, wherein a display device of the at least one approaching vehicle warns the user based on the speed limit or an engine control unit generates a command for the at least one approaching vehicle based on the speed limit.

14. The non-transitory computer readable medium of claim 13, wherein the probe data includes probe data for a plurality of lanes of the roadway.

15. The non-transitory computer readable medium of claim 14, wherein a first lane of the plurality of lanes corresponds to a first K value of the plurality of K values and a second lane of the plurality of lanes corresponds to a second K value of the plurality of K values.

16. The non-transitory computer readable medium of claim 13, wherein the statistical value is a standard deviation, and the one or more thresholds include a first threshold that corresponds to a low standard deviation and a second threshold that corresponds to a high standard deviation.

17. The non-transitory computer readable medium of claim 13, wherein selecting the plurality of K values comprises:

reducing a number of clusters assigned to the historical probe data; and determining the plurality of bands of speed limits for the roadway based on centroids of the number of clusters assigned to the historical probe data.

18. The non-transitory computer readable medium of claim 13, wherein the at least one road segment includes a plurality of road segments downstream of the variable speed sign.

19. The non-transitory computer readable medium of claim 13, the instructions when executed are operable to perform:

selecting a plurality of initial medoid values; and switching at least one of the initial medoid values with a non-medoid point in the historical probe data, wherein the plurality of K values corresponds to the switched medoid values.

20. The non-transitory computer readable medium of claim 13, the instructions when executed are operable to perform:

removing data from the historical probe data based on anomalous driving behavior.

* * * * *